US008702274B2

(12) United States Patent
Breidenassel et al.

(10) Patent No.: US 8,702,274 B2
(45) Date of Patent: Apr. 22, 2014

(54) LIGHTING DEVICE AND ATTACHMENT ELEMENT FOR FIXING TO THE LIGHTING DEVICE

(75) Inventors: Nicole Breidenassel, Bad Abbach (DE); Tobias Frost, Burglengenfeld (DE); Guenter Hoetzl, Regensburg (DE); Thomas Preuschl, Sinzing (DE); Peter Sachsenweger, Zeitlarn (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 13/513,791

(22) PCT Filed: Nov. 15, 2010

(86) PCT No.: PCT/EP2010/067442

§ 371 (c)(1), (2), (4) Date: Jun. 4, 2012

(87) PCT Pub. No.: WO2011/067093

PCT Pub. Date: Jun. 9, 2011

(65) Prior Publication Data

US 2012/0236563 A1 Sep. 20, 2012

(30) Foreign Application Priority Data

Dec. 4, 2009 (DE) ..... 10 2009 047 493

(51) Int. Cl.
*F21V 21/00* (2006.01)

(52) U.S. Cl.
USPC ..... 362/249.02; 362/249.01; 362/382

(58) Field of Classification Search
CPC ..... F21V 21/14; F21V 17/14; H01L 51/5012
USPC ..... 362/184, 186, 800, 565; 313/504; 315/291, 294
See application file for complete search history.

(56) References Cited

U.S. PATENT DOCUMENTS 5,465,199 A 11/1995 Bray et al.

FOREIGN PATENT DOCUMENTS

| | | |
|---|---|---|
| CN | 2010324290 | 3/2008 |
| DE | 1000109 | 1/1957 |
| DE | 202008007267 | 7/2008 |
| EP | 2072890 | 6/2009 |
| JP | 01-95008 | 6/1989 |
| JP | 02-65812 | 5/1990 |
| JP | 05-166407 | 7/1993 |

*Primary Examiner* — Tracie Y Green
(74) *Attorney, Agent, or Firm* — Cozen O'Connor

(57) ABSTRACT

A lighting device, having at least one light outlet opening and at least two different fixing interfaces for the optional fixing of a respective attachment element optically upstream of the at least one light outlet opening.

16 Claims, 8 Drawing Sheets

LIGHTING DEVICE AND ATTACHMENT ELEMENT FOR FIXING TO THE LIGHTING DEVICE

RELATED APPLICATIONS

This is a U.S. national stage of application No. PCT/EP2010/067442, filed on Nov. 15, 2010. Priority is claimed on German Application No. 10 2009 047 493.5 filed on Dec. 4, 2009, the content of which is hereby incorporated hereby reference.

FIELD OF THE INVENTION

The invention relates to a lighting device, in particular an LED lighting device. The invention further relates to an attachment element, in particular an optical element, the attachment element being designed for fixing to the lighting device.

Until now a particular optical element (reflector, bulb, diffuser, etc.) has been associated with a particular LED lighting device and attached thereto by means of additional components such as screws or adhesives or by a non-detachable method such as welding, etc. Replacing the optical element with another, non-identical optical element is not envisaged, in particular if the optical elements are of a different size or type.

SUMMARY OF THE INVENTION

It is one object of the present invention to avoid the cited disadvantages of the prior art and in particular to provide a facility for easily replacing optical elements on a lighting device.

This and other objects are attained in accordance with one aspect of the present invention direct to a lighting device having at least one light outlet opening and at least two different fixing interfaces for optionally fixing a respective attachment element optically upstream of the at least one light outlet opening.

It is a development that the attachment element is an optical element, e.g. a reflective optical system, in particular a "downlight" or a "spotlight" reflector. The optical element can also be a refractive optical system, e.g. a bulb, a lens, a diffuser, etc. The attachment element can also comprise a non-optical element, such as a transparent cover disk.

It is a further development that the lighting device has multiple light sources, the light outlet opening representing a light outlet opening common to the multiple light sources. With a common outlet opening such as this, the emerging light can no longer in practice be associated with the individual light sources.

Preferably the at least one light source comprises at least one light-emitting diode. When multiple light-emitting diodes are present they can illuminate in the same color or in different colors. A color can be monochrome (e.g. red, green, blue, etc.) or multichrome (e.g. white). The light emitted by the at least one light-emitting diode can also be an infrared light (IR-LED) or an ultraviolet light (UV-LED). Multiple light-emitting diodes can generate a mixed light; e.g. a white mixed light. The at least one light-emitting diode can contain at least one wavelength-converting luminescent material (conversion LED). The at least one light-emitting diode can be present in the form of at least one individually housed light-emitting diode or in the form of at least one LED chip. Multiple LED chips can be mounted on a common substrate ("submount"). The at least one light-emitting diode can be fitted with at least one separate and/or common optical system for beam guidance, e.g. at least one Fresnel lens, collimator, etc. Instead of or in addition to inorganic light-emitting diodes, e.g. based on InGaN or AlInGaP, organic LEDs (OLEDs, e.g. polymer OLEDs) can be generally used. Diode lasers can also be used, for example. Alternatively the at least one light source can have e.g. at least one diode laser.

The at least two different fixing interfaces can differ in size (e.g. the same type of interface, but of different sizes) and/or type (e.g. twist lock interface, press lock interface).

For the optional fixing of the respective attachment element, in particular an optical element, it can be envisaged that just one of the two or more different fixing interfaces is occupied at the same time. Alternatively two or more different fixing interfaces can be occupied at the same time, e.g. an outer fixing interface with a reflector and an inner fixing interface with a diffuser.

The fixing of the respective attachment element, in particular an optical element, optically upstream of the at least one light outlet opening includes in particular the situation in which the respective attachment element is arranged in a light path emerging from the light outlet opening upstream of the light outlet opening. The attachment element has a suitable fixing interface or fixing counter-interface for fixing to the lighting device.

This lighting device has the advantage that in principle any attachment elements can be connected to the fixing interfaces. The attachment elements can be designed largely independently of the design of the lighting device. The at least two different fixing interfaces can in particular ensure that it is easily and optically effectively possible to fix attachment elements having different dimensions (e.g. diameters). The fixing interfaces can also be used for adjusting a position, an (additional) attachment element then not being fixed via one of the fixing interfaces, but being inserted therein in order to adjust the position.

It is an embodiment that the at least one light outlet opening is a light outlet opening of a light guidance element fed by multiple light sources. A high luminous intensity can be achieved in this way. The light guidance element can be e.g. a reflector, an optical waveguide, etc., which guides light from the light sources to the defined light outlet opening. The reflector can have one or more specular or diffusely reflecting reflector surfaces.

The light guidance element can in particular have an essentially hollow cylindrical shape. The hollow cylinder can be of general shape and can have e.g. a circular, oval, rectangular or freeform cross-section. A transition in the shape of the cross-section is also possible, e.g. from a round receiving surface to a polygonal geometrical shape.

It is another embodiment that the different fixing interfaces hold the attachment elements, in particular optical elements, at an identical, in particular vertical, spacing from the associated light outlet opening. By standardizing this spacing, it is even easier to adapt the attachment elements to the lighting device. To this end the fixing interfaces can for example be set at the same height.

It is another embodiment that the different fixing interfaces are of the same type. This further makes it easier to adapt different attachment elements to the lighting device.

It is a development that the fixing interfaces are each designed as a twist lock means. The locking means has the advantage that an attachment element can be fixed to the lighting device and preferably also removed therefrom again without the use of tools. Furthermore, a secure connection is achieved. The attachment element has suitable twist lock means for fixing to the lighting device.

It is another development that the fixing interfaces are each designed as a screw lock means. To this end the fixing interfaces can have a thread or a thread-like structure. The attachment element can then have a suitable counterthread, by means of which it can be screwed into the lighting device.

It is another development that the fixing interfaces are designed as a bayonet lock means. The bayonet lock means has the advantage that it is typically fitted with a latching means to prevent an inadvertent release of the attachment element connected thereto, and an insertion slot or longitudinal slot can also serve as a position adjustment region or element because of its ease of accessibility and defined position. To this end an attachment element can for example be inserted into the bayonet lock means (bayonet socket, etc.), but not rotated to fix it. In other words the bayonet lock means then serves for the defined mounting of the attachment element, which can be fixed in another way.

Generally the fixing interfaces can each have at least one latching element to prevent the fixture from being released.

It is an embodiment that the fixing interfaces concentrically surround the associated light outlet opening, in particular at a different lateral spacing. As a result a radially even light emission can be easily achieved. For example, two or more twist lock means can e.g. have corresponding circular sockets or fittings which have the same axis of symmetry as the light outlet opening.

It is an embodiment that the lighting device is a lighting module. The lighting module can in particular have a printed circuit board, which is populated in a central region of a front side with at least one light source and has further electronic components in a surrounding region surrounding the central region, e.g. resistors, capacitors and/or logic modules, e.g. as part of a driver logic circuit. The further electronic components located in the surrounding region can be overarched by a cover, which in particular rests on the printed circuit board.

The cover can in particular be an annular cover. The annular cover can in particular have a cylindrical inner wall (corresponding to an inner lateral surface or inner side wall) which laterally surrounds the central region of the lighting module, as well as a cylindrical outer wall (corresponding to an outer lateral surface or outer side wall). The outer wall is preferably the same height as the inner wall, but has a larger diameter than the inner wall which surrounds the surrounding region on the outside. The rear edges of the inner wall and of the outer wall can rest on the printed circuit board and at their front edges they can be connected by a top wall. The top wall can in particular be an annular, planar top wall.

The light guidance element can in particular be arranged inside and laterally concentrically to the inner wall of the lighting module. The light guidance element and the annular cover can be the same height.

It is also an embodiment that one of the fixing interfaces is integrated into the outer wall of the annular cover of the lighting module and another of the fixing interfaces is integrated into the inner wall of the annular cover of the lighting module.

It is moreover an embodiment that the at least one light outlet opening and a respective at least one feed opening of the at least two different fixing interfaces essentially lie in the same plane. As a result the attachment element can particularly easily be brought close to the light outlet opening, which prevents light losses. The fixing interfaces themselves can be located beneath the light outlet opening, in order to achieve sufficient insertion depth for a secure seat. It is a special embodiment of a lighting module that the top edges of the inner wall and of the outer wall and the light outlet opening essentially lie in the same plane. As a result an attachment element can easily be moved up against the annular cover and at the same time can be attached to the light outlet opening without any significant vertical spacing.

It is moreover an embodiment that an attachment element is at least inserted into one of the fixing interfaces.

This insertion can be for the purpose of adjusting the position of the attachment element in respect of the lighting device, without the attachment element needing to be attached to the lighting device via the fixing interface.

It is another embodiment that the attachment element is attached by means of one of the fixing interfaces.

The object is also achieved by an attachment element, in particular an optical element, the attachment element being designed for fixing to the lighting device. To this end the attachment element can in particular be fitted with a fixing (counter-)interface matching one of the fixing interfaces.

BRIEF DESCRIPTION OF THE DRAWINGS

In the following figures the invention is described in greater detail on the basis of exemplary embodiments. For the sake of clarity identical or equivalent elements can be provided with the same reference characters.

DETAILED DESCRIPTION OF THE DRAWINGS

Figure 1:
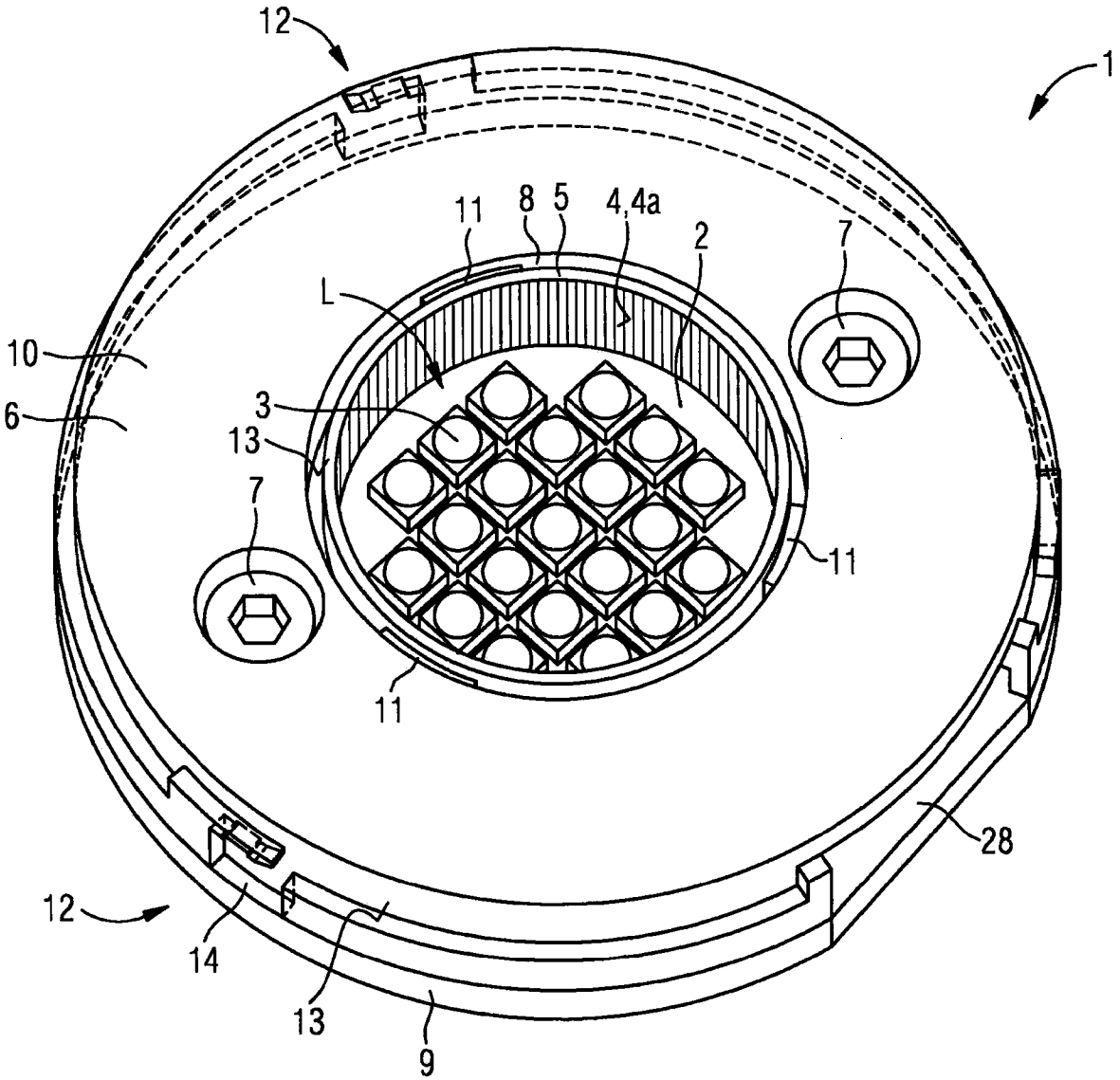
FIG. 1 shows an oblique front or top view of an inventive lighting module.
Figure 2:
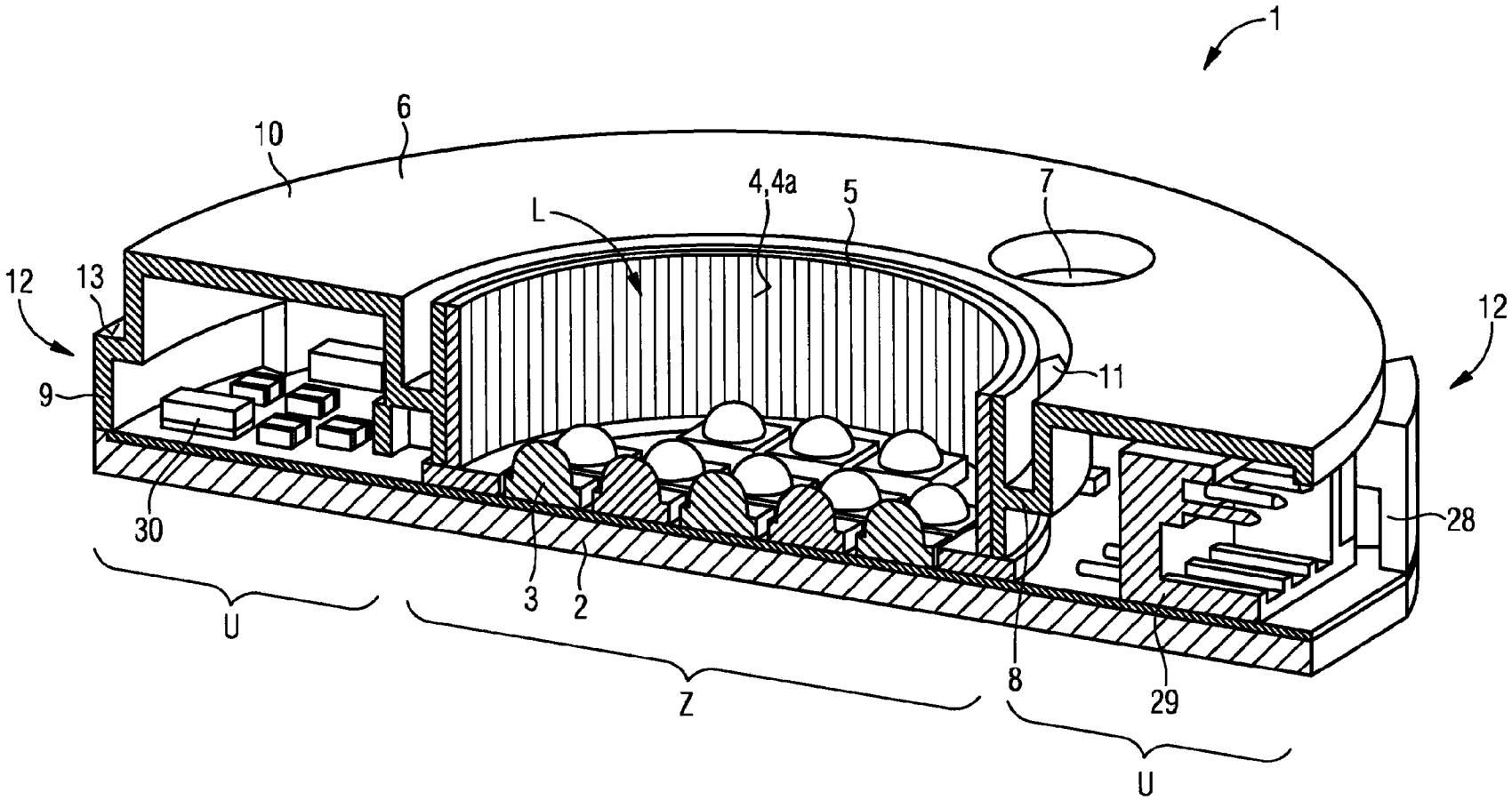
FIG. 2 shows an oblique sectional view of the lighting module.

FIG. 1 shows an oblique front or top view of an inventive lighting module 1 without attachment element. FIG. 2 shows an oblique sectional view of the lighting module.

The lighting module 1 has an essentially disk-shaped printed circuit board 2, which is populated in a central region of a front side with at least multiple light sources in the form of light-emitting diodes 3. A light guidance element 4 (here essentially a hollow cylinder) common to the light-emitting diodes 3 surrounds the light-emitting diodes 3. The rear edge of the light guidance element 4 rests on the printed circuit board 2, whereas a front edge 5 surrounds a light outlet opening L. The light outlet opening L in other words corresponds to a front-side opening of the light guidance element 4. The light guidance element 4 is here designed as a diffusely reflecting element with a structured reflection surface 4*a*.

The printed circuit board 2 is further populated in a surrounding region surrounding the central region with further electronic components 30, e.g. with resistors, capacitors and/or logic modules, e.g. as part of a driver logic system. The further electronic components located in the surrounding region are overarched by an annular cover 6, the rear edge of which rests on the printed circuit board 2. The annular cover 6 can be connected by friction locking to the printed circuit board 2 e.g. by means of two pins as an assembly connection. The screws 7 are used to fix the lighting module 1, in particular the back thereof, to e.g. a heat sink (not illustrated). The annular cover 6 has a plug lead-through 28 for electrically contacting a plug 29 likewise fitted on the printed circuit board 2.

Figure 3:
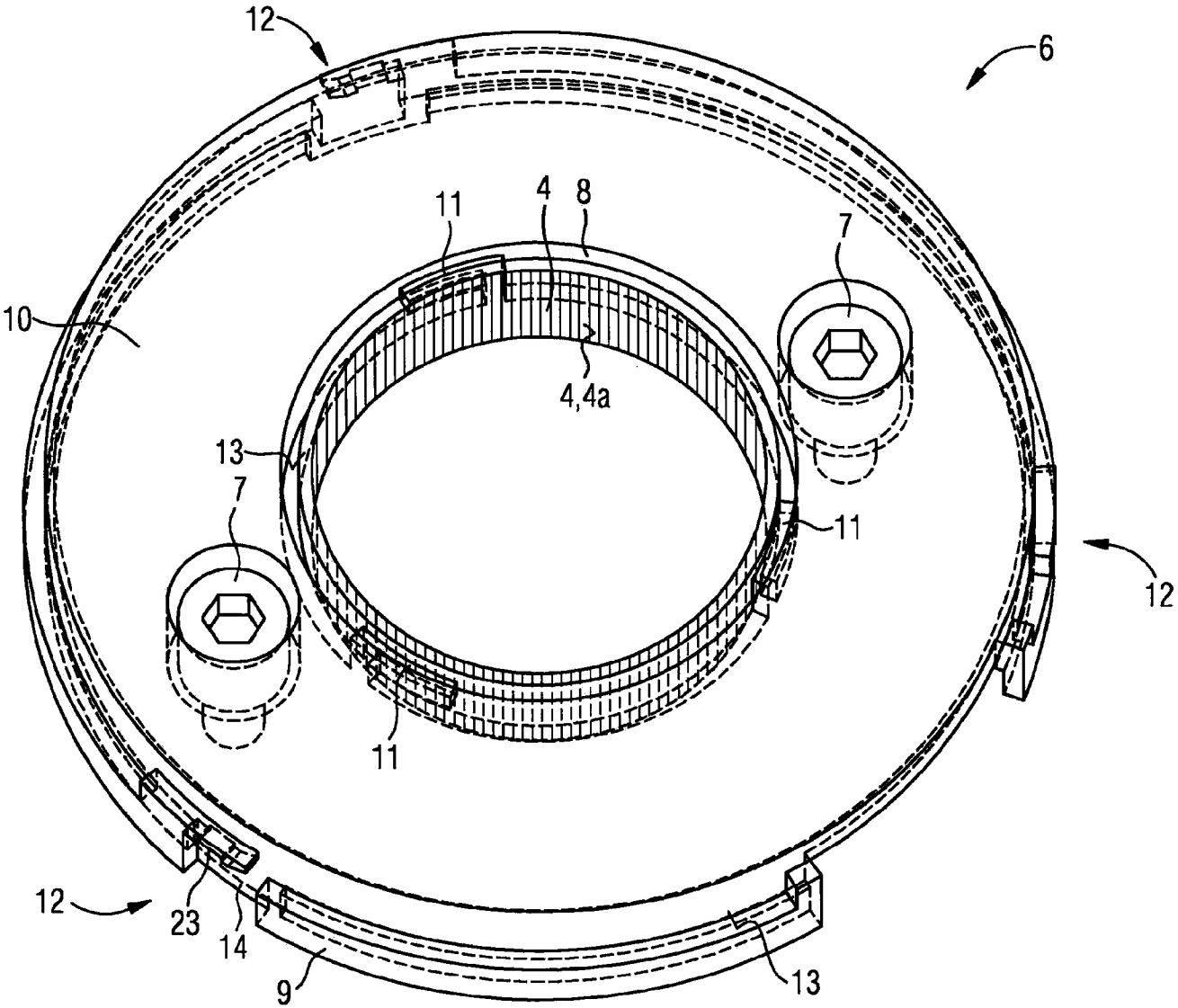
FIG. 3 shows an oblique front view of an annular cover of the lighting module.

The annular cover 6 has, as also shown in FIG. 3, an essentially cylindrical inner wall 8 (corresponding to an inner lateral surface or inner side wall), which concentrically laterally surrounds the central region of the lighting module 1 and thus also the light guidance element 4. The annular cover 6 further has an essentially cylindrical outer wall 9 (corresponding to an outer lateral surface or outer side wall). The outer wall 9 can be the same height as the inner wall 8. The rear edges of the inner wall 8 and of the outer wall 9 can rest on the printed circuit board 2 and at their front edges they can be connected by a top wall 10. The top wall 10 is here embodied as a circular, planar top wall 10. The light guidance element 4 and the annular cover 6 can be separate components, connected to one another or integrated with one another.

A first fixing interface in the form of an inner bayonet socket 11 is integrated into the inner wall 8 of the annular cover 6. A second fixing interface in the form of an outer bayonet socket 12 is integrated into the outer wall 9 of the annular cover 6. Each of the bayonet sockets 11 and 12 has three longitudinal slots 13, each of which is accessible from the front, at the end of which a short transverse slot 14 is positioned at right angles. The longitudinal slot 13 has a horizontal base which can also be used as a position adjustment aid. The longitudinal slot 13, and thus also the short transverse slot 14, lie below the planar surface of the top wall 10, in order to provide a secure seat. In other words the bayonet sockets 11 and 12 lie below the surface or top edge of the lighting module 1.

An attachment element can have a bayonet fitting matching one of the bayonet sockets 11 or 12 (see also FIG. 5), which can be inserted into the longitudinal slot 13 and can be fixed by rotating it into the transverse slot 14. To latch the bayonet socket and the bayonet fitting a wall of the transverse slot 14 has a latching element 23, over which a corresponding latching (counter-)element 15 of the bayonet fitting can be pushed.

The light outlet opening L and the inner wall 8 and the outer wall 9 terminate at the same height. As a result an attachment element can easily be moved up against the annular cover. In other words the lighting module 1 has a planar front, at which the annular cover 6 and the light guidance element 4 terminate flush. The planar front side can alternatively be divided into different height profiles by further elements, such as diffusers.

The lighting module 1 can be inserted into a heat sink (not illustrated).

Figure 4:
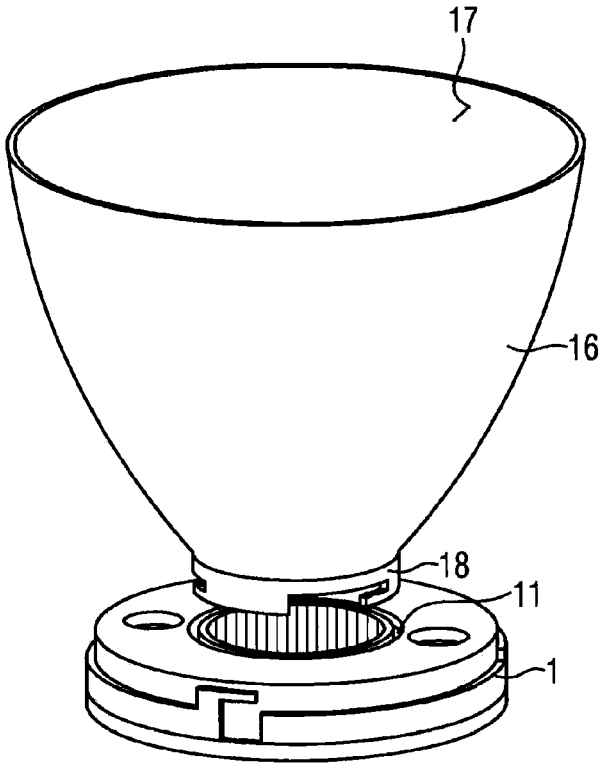
FIG. 4 shows an oblique view of the lighting module with an optical element floating above it in the form of a reflector.
Figure 5:
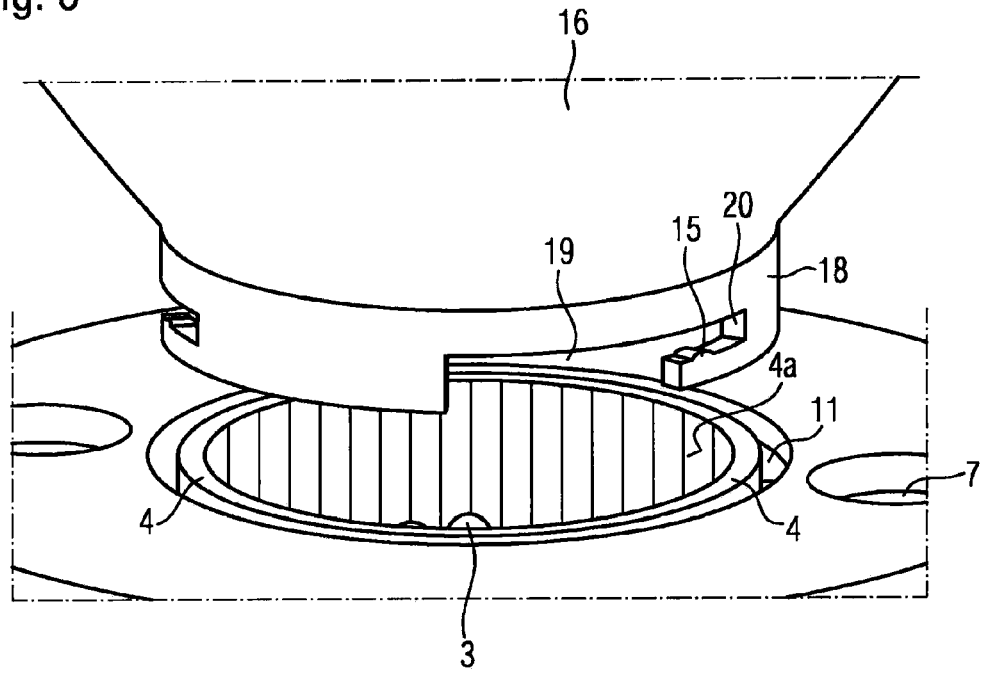
FIG. 5 shows an enlarged section of the lighting module with the reflector floating above it in a region of an inner fixing interface of the lighting module.

FIG. 4 shows an oblique view of the lighting module 1 with an optical element floating above it as the attachment element in the form of a reflector 16. FIG. 5 shows an enlarged section of the lighting module with the reflector 16 floating above it in a region of the inner bayonet socket 11. The reflector 16 has a pot-shaped, e.g. parabolic, reflecting inner side 17 and can be attached using a rear light outlet opening (not illustrated) at or near the light outlet opening L of the light guidance element 4. For fixing to the lighting module 1 the reflector 16 has a rear bayonet fitting 18 for engagement with the inner (smaller) bayonet socket 11 of the lighting module 1. The bayonet fitting 18 has three longitudinal slots 19 and transverse slots 20 complementary to the bayonet socket, a latching lug 15 being located in the transverse slot 20.

Figure 6:
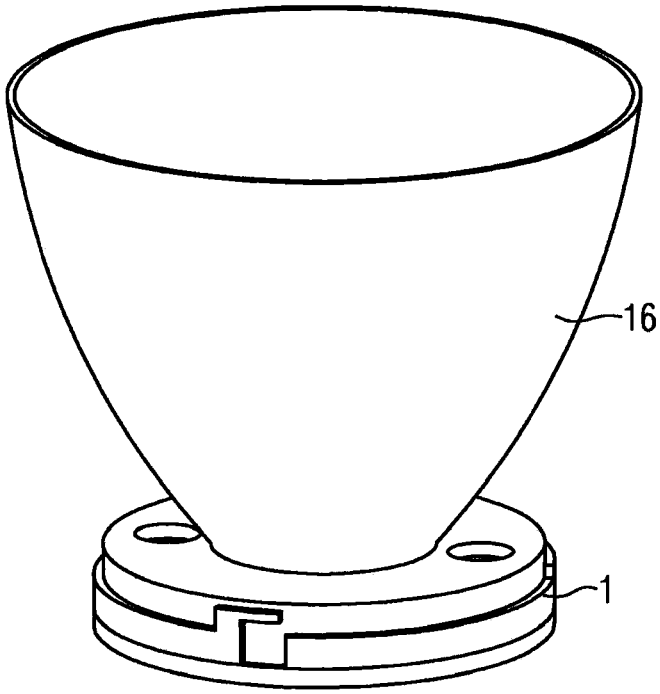
FIG. 6 shows an oblique lateral view of the lighting module with the reflector inserted.

FIG. 6 shows the lighting module 1 with the reflector 16 inserted therein. Thanks to the inner bayonet lock 11 arranged in defined manner in respect of the light outlet opening L of the light guidance element 4 the reflector 16 can be attached to the light outlet opening L with discretionary spacing, in particular essentially with no (vertical) spacing, so that the rear light inlet opening of the reflector 16 can essentially connect directly to the light outlet opening L of the light guidance element 4. As a result, light losses are prevented. This 'standardized' fixing interface permits various attachment elements (reflectors, bulbs, diffusers, etc.) to be designed largely independently of development of the lighting module 1. The reflector 16 encloses the light-emitting area or light outlet opening L completely, so that extensive opaqueness is ensured, which in turn produces a high optical efficiency.

Figure 7:
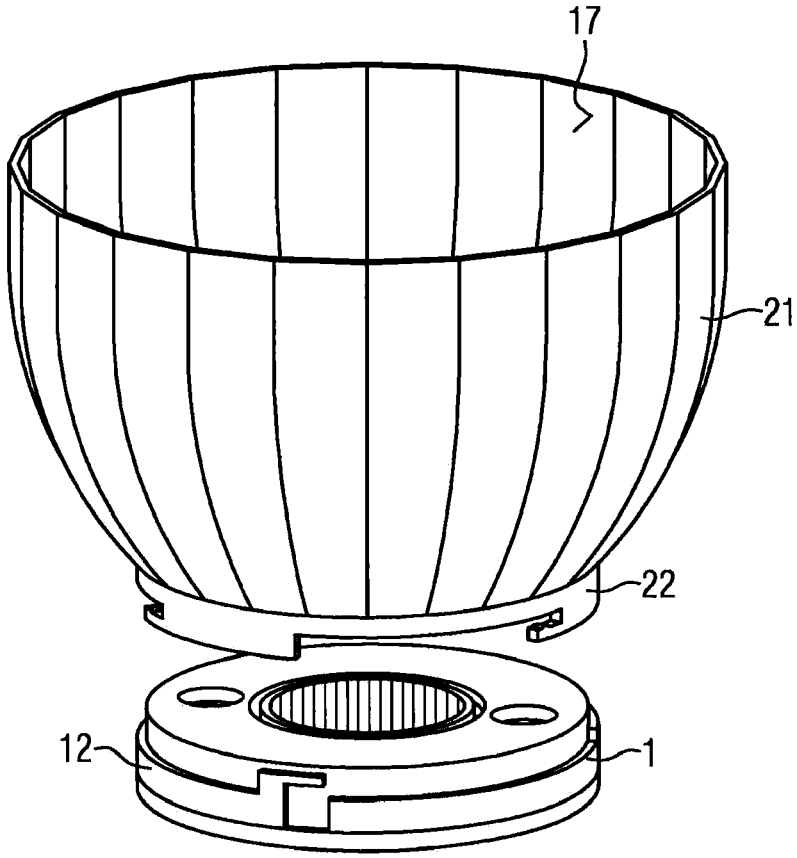
FIG. 7 shows an oblique lateral view of the lighting module with a further reflector floating above it.
Figure 8:
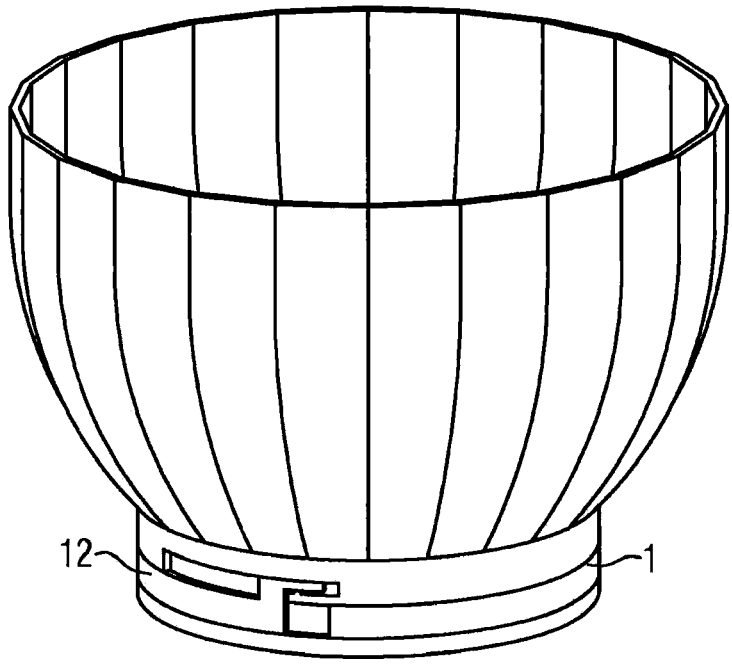
FIG. 8 shows an oblique lateral view of the lighting module with the further reflector inserted.

FIG. 7 shows the lighting module 1 with a further reflector 21 floating above it, and FIG. 8 shows the lighting module 1 with the further reflector 21 inserted. The further reflector 21 has a wider light inlet opening (not illustrated) and on the reverse is accordingly fitted with a wider bayonet fitting 22 (with a larger diameter than the bayonet fitting 18). The further reflector 21 engages with the bayonet fitting 22 into the outer bayonet socket 12 and can be inserted into it analogously to the reflector 16 with the smaller bayonet fitting 18 and if necessary latched.

Alternatively a reflector, or another attachment element (optical element, protection element, etc.), may not have a bayonet fitting, but can have e.g. projections that can be inserted into the longitudinal slots 13 of the bayonet fitting 11 or 12, by means of which the position of the reflector can be adjusted in respect of the lighting module 1, while fixing can be effected in another way, or not to the lighting module if appropriate. The vertical spacing from the light outlet opening L is in other words permanently defined and is also independent of whether the reflector is fixed to the lighting module or only its position is adjusted (attached).

Figure 9:
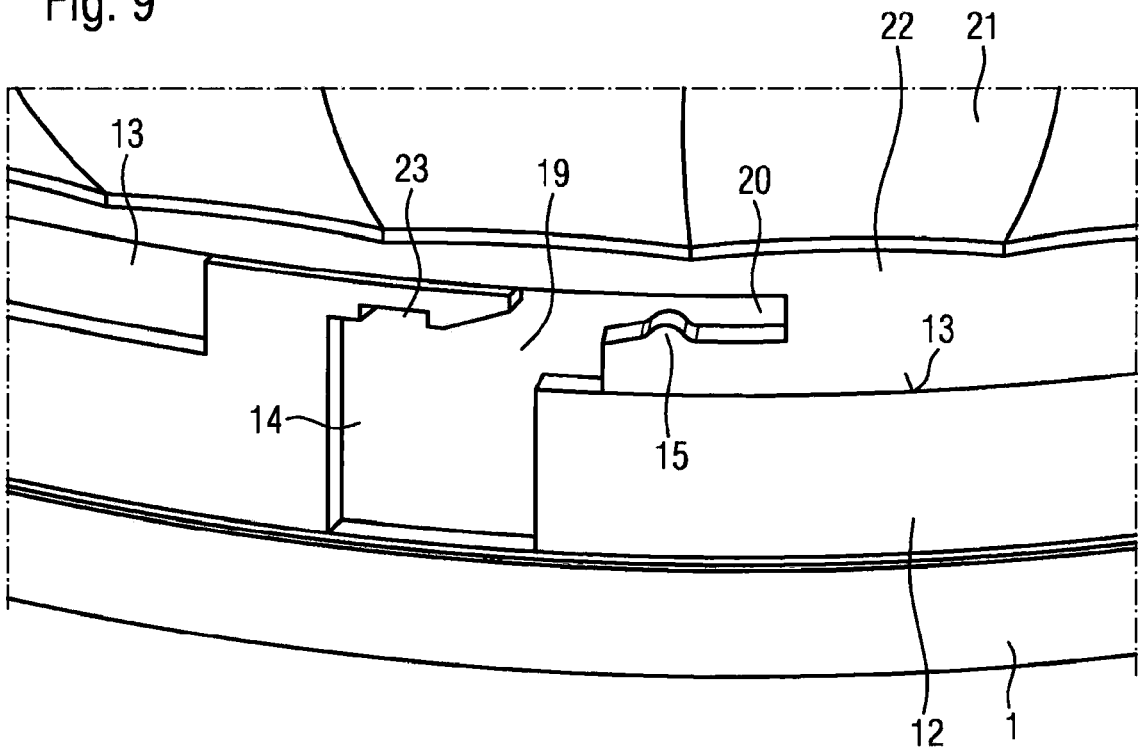
FIG. 9 shows a section of the lighting module with the inserted further reflector in the region of an outer fixing interface of the lighting module.
Figure 10:
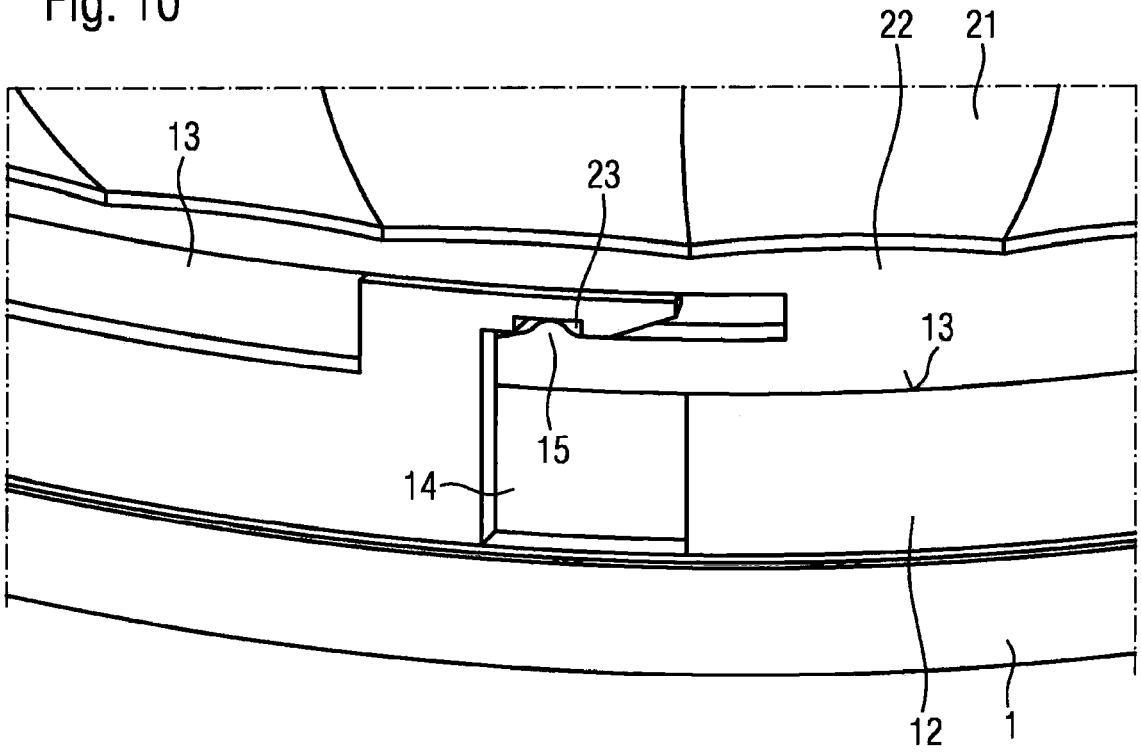
FIG. 10 shows a section of the lighting module with the inserted and fixed further reflector in the region of an outer fixing interface of the lighting module.

FIG. 9 shows a section of the lighting module 1 with the inserted further reflector 21 in the region of the outer bayonet socket 12. The bayonet fitting 22 lies on a lower edge of the outer bayonet socket 12, which has a defined position in respect of the light outlet opening L. The two transverse slots 14 and 20 are not yet brought into engagement, so that the reflector 21 is not yet fixed in the lighting module 1. Not until the reflector 21 and the lighting module 1 are twisted are the two transverse slots 14 and 20 brought into engagement, as shown in FIG. 10. In this case the latching lug 15 located in the transverse slot 20 of the bayonet fitting 22 engages for latching purposes here with a corresponding latching cutout 23 in the transverse slot 14 of the outer bayonet socket 12.

Figure 11:
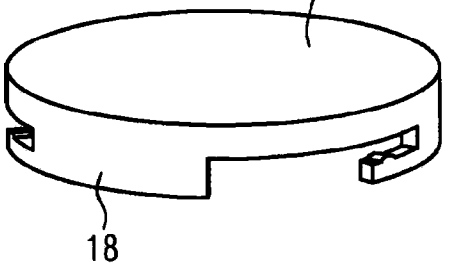
FIG. 11 shows an optical element suitable for insertion into the lighting module in the form of a diffuser.
Figure 12:
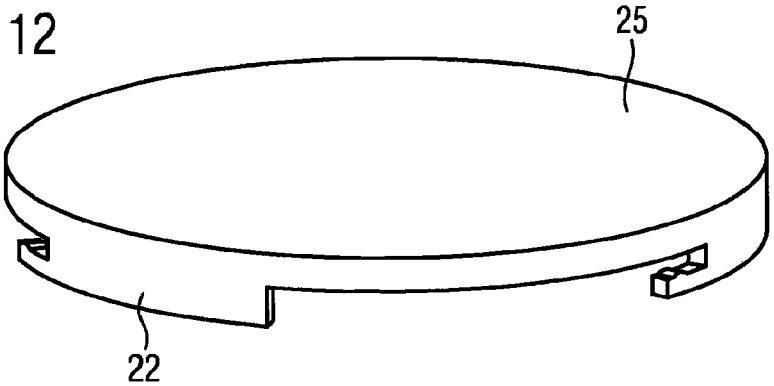
FIG. 12 shows a further optical element suitable for insertion into the lighting module in the form of a diffuser.

FIG. 11 shows an optical element suitable for insertion into the inner bayonet socket 11 in the form of a diffuser 24 or a cover disk. The diffuser 24 has a bayonet fitting 18 identical to the reflector 16 at its rear end. FIG. 12 shows an optical element suitable for insertion into the outer bayonet socket 12 in the form of a further diffuser 25 or a cover disk, the diffuser 25 now having a bayonet fitting 22 identical to the reflector 21 at its rear end.

Figure 13:
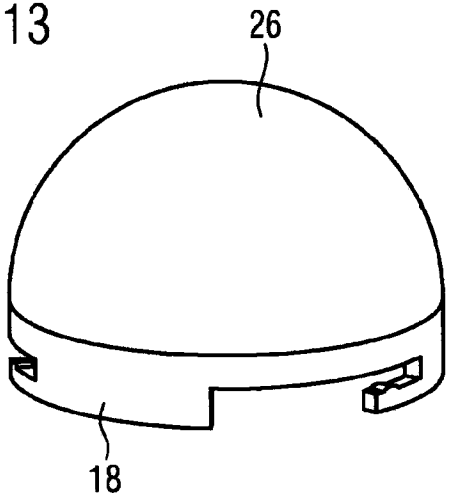
FIG. 13 shows an optical element suitable for insertion into the lighting module in the form of a bulb.
Figure 14:
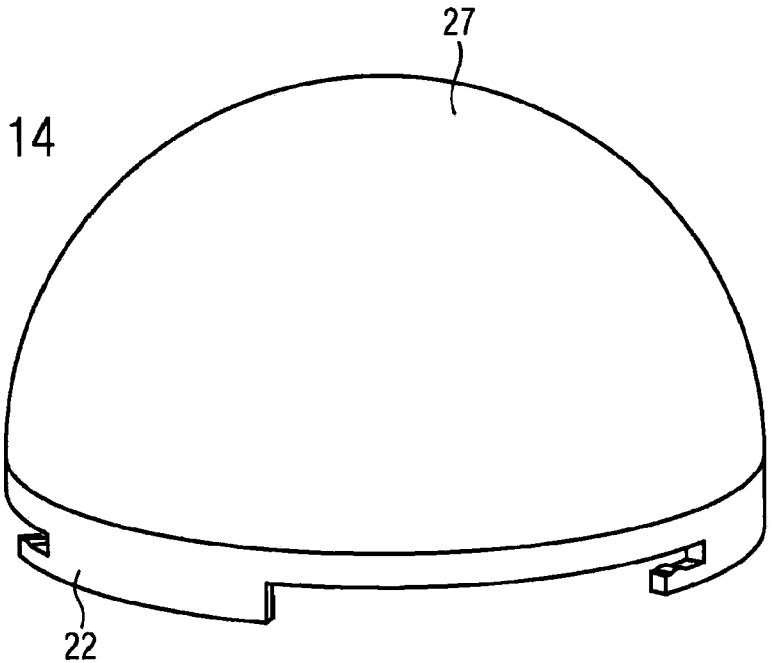
FIG. 14 shows an optical element suitable for insertion into the lighting module in the form of a further bulb.

FIG. 13 shows an optical element suitable for insertion into the inner bayonet socket 11 in the form of a bulb 26. The bulb 26 has a bayonet fitting 18 identical to the reflector 16 at its rear end. FIG. 14 shows an optical element suitable for insertion into the outer bayonet socket 12 in the form of a further bulb 27, the bulb 27 now having a bayonet fitting 22 identical to the reflector 21 at its rear end.

The present invention is of course not limited to the exemplary embodiments shown.

Thus a screw lock, a plug-in lock, a latching lock (e.g. with snap-fit hooks), etc. can also be used instead of a bayonet lock, for example.

Generally the areas of the attachment element relevant to assembly are fully decoupled from the optically relevant areas (light outlet opening, etc.), so the desired light emission of an attached attachment element can be set independently of the connection technique (bayonet lock, etc.).

The attachment element, electrically conductive if appropriate, can be electrically insulated from the electronics or printed circuit board 2 by being coupled to an electrically insulating housing part, e.g. an annular cover made of plastic.

The inner bayonet socket 11 (or generally one of the fixing interfaces) can be occupied with a diffuser, and the outer bayonet socket 12 (or generally another of the fixing interfaces) can be occupied with a reflector, bulb, etc. It is thus possible for two or more fixing interfaces to be occupied at the same time.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A lighting device, comprising:

a light outlet opening;

a light source;

at least one electronic component;

a printed circuit board populated with the light source and the at least one electronic component;

an annular cover that surrounds the light source at said light outlet opening, and covers the at least one electronic component; and at least two different fixing interfaces configured to detachably fix a respective attachment element arranged optically upstream of the at least one light outlet opening.

2. The lighting device as claimed in claim 1, wherein the at least two different fixing interfaces hold the attachment elements at a same spacing from the at least one associated light outlet opening.

3. The lighting device as claimed in claim 1, wherein the at least two different fixing interfaces are of a same type.

4. The lighting device as claimed in claim 3, wherein the at least two different fixing interfaces are configured as twist locks.

5. The lighting device as claimed in claim 4, wherein the at least two different fixing interfaces are configured as screw locks.

6. The lighting device as claimed in claim 5, wherein the at least two different fixing interfaces are configured as bayonet locks.

7. The lighting device as claimed in claim 1, wherein the at least two different fixing interfaces each have at least one latching element.

8. The lighting device as claimed in claim 1, wherein the at least two different fixing interfaces concentrically surround the at least one light outlet opening.

9. The lighting device as claimed in claim 1, wherein the light outlet opening is a light outlet opening of a light guidance element fed by multiple light sources.

10. The lighting device as claimed in claim 1, wherein the light outlet opening and a respective at least one feed opening of the at least two different fixing interfaces essentially lie in a same plane.

11. A lighting device, comprising:

a light outlet opening;

at least two different fixing interfaces configured to fix a respective attachment element arranged optically upstream of the light outlet opening;

a printed circuit board populated with multiple light sources and electronic components;

a light guidance element configured as a hollow cylinder and arranged to laterally surround the light sources at said light outlet opening; and an annular cover that laterally surrounds the light guidance element and configured to cover the electronic components, wherein one of the fixing interfaces is integrated into an outer wall of the annular cover and another of the fixing interfaces is integrated into an inner wall of the annular cover.

12. The lighting device as claimed in claim 11, wherein top edges of the inner wall and of the outer wall and the light outlet opening essentially lie in a plane.

13. The lighting device as claimed in claim 1, wherein a respective attachment element is at least inserted into one of the fixing interfaces.

14. The lighting device as claimed in claim 13, wherein the respective attachment element is fixed by the one of the fixing interfaces.

15. The lighting device as claimed in claim 1, wherein said attachment element is an optical element.

16. The lighting device as claimed in claim 1, wherein the attachment element is at least one of a reflector and a diffuser.

* * * * *